United States Patent [19]

Dyer

[11] 4,047,583

[45] Sept. 13, 1977

[54] EARTH BORING CUTTING ELEMENT RETENTION SYSTEM

[75] Inventor: Norman Dean Dyer, Plano, Tex.

[73] Assignee: Dresser Industries, Inc., Dallas, Tex.

[21] Appl. No.: 691,732

[22] Filed: June 1, 1976

[51] Int. Cl.[2] ..... E21C 13/00

[52] U.S. Cl. ..... 175/410; 175/374; 403/334

[58] Field of Search ..... 403/333, 334; 175/374, 175/410, 413; 299/91

[56] References Cited

U.S. PATENT DOCUMENTS

| | | | |
|---|---|---|---|
| 2,097,030 | 10/1937 | Killgore | 175/410 |
| 2,121,202 | 6/1938 | Killgore | 175/410 |
| 3,311,181 | 3/1967 | Fowler | 175/410 |
| 3,717,209 | 2/1973 | Sheldon et al. | 175/374 X |
| 3,807,804 | 4/1974 | Kniff | 175/410 X |
| 3,852,874 | 12/1974 | Pearson | 175/410 X |
| 3,858,671 | 1/1975 | Kita | 175/410 |

FOREIGN PATENT DOCUMENTS

| | | | |
|---|---|---|---|
| 707,021 | 4/1954 | United Kingdom | 175/410 |

*Primary Examiner*—Ernest R. Purser
*Assistant Examiner*—Richard E. Favreau
*Attorney, Agent, or Firm*—Eddie E. Scott

[57] ABSTRACT

An earth boring apparatus includes individual cutting elements positioned within corresponding individual sockets in the cutter member body of the apparatus. Each socket has a socket wall and each cutting element has a lower body portion with a surface that contacts the socket wall. In one embodiment the sockets are cylindrical and a substantial portion of the lower body surfaces have a conical taper. This provides an improved fit of the lower body surface along the length of the socket wall and reduces cutting element loss.

5 Claims, 8 Drawing Figures

EARTH BORING CUTTING ELEMENT RETENTION SYSTEM

BACKGROUND OF THE INVENTION

The present invention relates in general to the art of earth boring and more particularly to a system for retaining the cutting elements in the cutter member body of an earth boring apparatus.

Cutting element life and efficiency are of prime importance in boring holes in the earth. For example, cutting element life and efficiency are important in drilling oil and gas wells and boring tunnels and raise holes. In general, the penetration rate is directly related to the condition of the cutter member and the condition of the cutter member is related to the condition and orientation of the cutting elements.

Cutter members having carbide insert cutting elements located in the body of the cutter member are generally utilized because of the ability of the carbide insert cutting elements to penetrate hard formations. The carbide inserts are mounted in a relatively soft metal forming the body of the cutter member. The most commonly used method of securing the inserts in the cutter member body is to provide cylindrical sockets in the cutter member body, to mold the inserts into a cylindrical shape, and to press-fit the inserts in the sockets in the cutter member body. The inserts are retained in the cutting member body by "hoop" tension generated when the insert is pressed into the relatively soft cutter member body. It has been discovered that when the inserts are press-fitted into the sockets, the sockets tend to be warped and a proper fit along the full length of the insertion is not obtained. Such inserts can become disoriented in the sockets during the earth boring operation and premature failure of the cutter can result. In addition, a rotary bit failure has been discovered known as cone peeling. This is a failure by cracking of the cone metal parallel to the bottom of the tungsten carbide insert in such a manner to remove the outer layer of the cone material and the inserts. This failure occurs near the bottom corner of the drilled holes for the tungsten carbide inserts.

Prior to the present invention the inserts were generally cylindrical sections pressed into radial cylindrical sockets in the cutter member. Since the cutter members have a circular cross-section, the interference fit at the lower portion of the socket caused expansion of the socket at the upper portion and loss of fit. The loss of fit resulted in the inserts becoming loosened in the cutter member body and premature failure of the cutter member. Cone peeling was also encountered. The present invention provides an improved fit throughout the length of the insert and promotes insert retention. cl

BRIEF DESCRIPTION OF PRIOR ART

In U.S. Pat. No. 3,389,761 to Eugene G. Ott, patented Aug. 25, 1968, a rotary drill bit is shown including a rolling cutter having sintered metallic carbide inserts located in the cutter surface. The inserts include a plurality of alternate ridges and valleys on the side surface thereof that are sized to engage the walls of the holes in the rolling cutter whereby the inserts are retained in the rolling cutter against both longitudinal and rotational movement relative to the cutter.

In U.S. Pat. No. 2,097,037 to R. J. Kilgore, patented Oct. 26, 1937, a rock drill bit is shown in which hard metal inserts are tapered inwardly and are seated in tapered openings formed in the bottom of the bit. The tapered inserts do not bottom in the tapered openings and are accordingly held against being driven into engagement with the bottoms of the openings by the tapered side walls of the openings. The walls of the openings press forcibly against the inserts and tend to compress the inserts radially as well as prevent or resist inward movement of the inserts in their tapered openings.

In U.S. Pat. No. 3,311,181 to J. B. Fowler, patented Mar. 28, 1967, a bi-metal drilling tooth is shown. The drilling tooth includes a working section and a leading holding section.

In U.S. Pat. Nos. 3,461,983 and 3,513,728 to Lester S. Hudson and Eugene G. Ott jointly, patented Aug. 19, 1969 and May 26, 1970 respectively, an apparatus is shown that includes a member having a surface thereon exposed to an abrasive environment, the member having a relatively hard insert pressed into a hole in the member and having a hardfacing material on the surface of the member surrounding the insert. A method of manufacturing the apparatus is shown wherein the hole is plugged and hardfacing material is applied to the surface around the plug. After the hardfacing material has been permanently bonded to the surface, the plug is removed and the hard insert pressed into the hole to complete the apparatus.

In U.S. Pat. No. 3,599,737 to John F. Fisher, patented Aug. 17, 1971, a drilling tool or the like is shown with hardened metal inserts of molded sintered metal turned to cylindrical shape by centerless grinding and provided, prior to centerless grinding, with out-of-round abutment portions, the inserts being press-fitted into cavities in the cutter and the material of the cutter being staked to displace metal into engagement with the out-of-round abutment portions of the inserts to prevent axial and rotational displacement.

In U.S. Pat. No. 3,749,190 to Clarence S. Shipman, patented July 31, 1973, a rock drill bit having tapered carbide buttons projecting from its working face is described in which the buttons are retained in the bit by means of sleeves which are extruded into undercuts of the button holes and retain the carbide buttons in the drill bit by virtue of the sheer strength of the sleeves.

SUMMARY OF THE INVENTION

The present invention provides an earth boring apparatus having hardened inserts positioned in sockets in the cutter body of the apparatus. The inserts and the sockets are shaped to maintain a preferred fit along the entire length of the insertions. The sockets have a socket wall and the inserts have a lower body portion positioned within the sockets with the lower body portion having a lower body surface that contacts the socket wall. At least a portion of one of said socket wall and lower body surface is tapered so that the insert and the socket have an improved fit substantially throughout the entire length of the insertion. The above and other features and advantages of the present invention will become apparent from a consideration of the following detailed description of the invention, when taken in conjunction with the accompanying drawings.

DETAILED DESCRIPTION OF THE INVENTION

Figure 1:
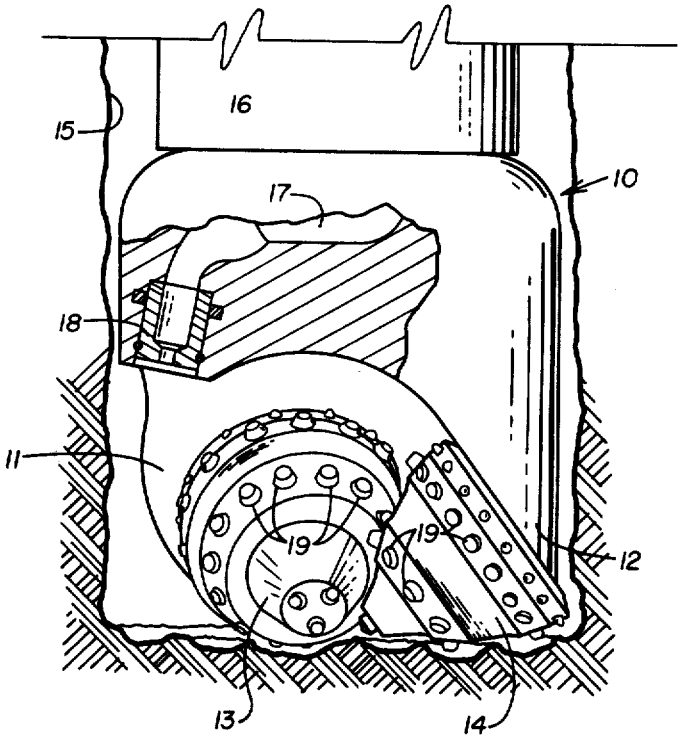
FIG. 1 is a partially cut-away illustration of a rock bit incorporating the present invention.

Referring now to the drawings and to FIG. 1 in particular, a rotary rock bit generally designated by the reference number 10 is shown positioned in an earth borehole 15. As illustrated, the rotary rock bit 10 is connected to the lower end of a rotary drill string 16. The bit 10 includes an internal cavity 17 that extends through the upper portion of the bit 10. The cavity 17 is in communication with the central passage of the drill string 16. A nozzle 18 allows drilling fluid circulated through the drill string 16 into cavity 17 to be discharged to the bottom of the borehole 15 thereby flushing cuttings and debris from the bottom of the borehole 15. The cuttings and debris are carried upward in the annulus between the drill string 16 and the wall of the borehole 15.

The bit 10 includes three substantially identical arms. Arms 11 and 12 are shown in FIG. 1. Cone cutter members 13 and 14 are rotatably positioned on the arms 11 and 12 respectively. The cone cutter members 13 and 14 include a multiplicity of hard inserts 19 projecting from the body of the cutter members. As the bit 10 and cutters 13 and 14 rotate, the inserts contact and disintegrate the formations to form the desired borehole.

Figure 2:
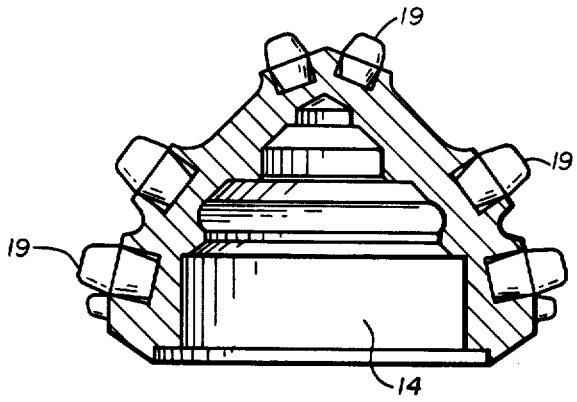
FIG. 2 shows a sectional view illustration of one of the cone cutters of the rock bit shown in FIG. 1.

Referring now to FIG. 2, a sectional view of cone cutter 14 is illustrated. The inserts 19 are constructed of a hard metal such as tungsten carbide. The hard metal inserts are mounted in the relatively soft metal forming the body of the cone cutter 14.

Figure 3:
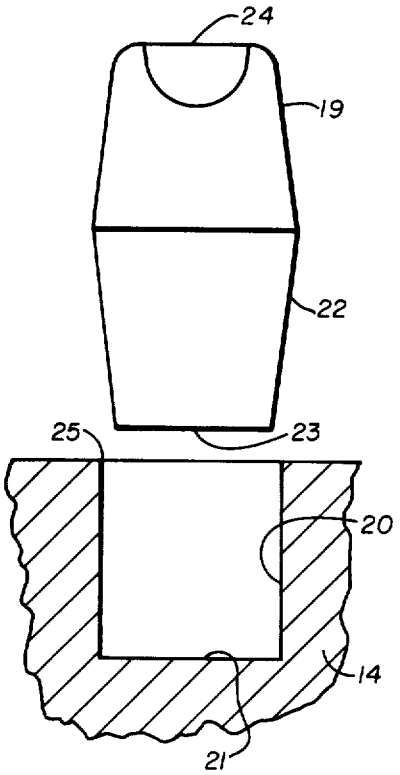
FIG. 3 is an enlarged view of one of the inserts in the cone cutter shown in FIGS. 1 and 2.

Referring now to FIG. 3, and enlarged view of one of the inserts 19 and a portion of the cone cutter 14 is illustrated. The insert 19 includes a lower base section 22 adapted to be positioned in a socket or cavity 20 in the body of the cone cutter 14. The upper portion of the insert 19 is formed into a chisel crest portion 24 for contacting and disintegrating the earth formations. The base section of insert 19 terminates in a lower end 23. The base section 22 of the insert 19 is pressed through the socket mouth 25 into the socket 20 until the end 23 of the insert 19 contacts the bottom 21 of the socket 20. The outer surface of base section 22 is tapered such that upon assembly of the insert 19 in the socket 20, the outer surface of base section 22 and the wall of the socket 20 have an improved fit substantially throughout the length of the base section 22 of insert 19. The angle of the taper of the tapered surface is such that the coefficient of friction of the tungsten carbide insert 19 and the softer cone cutter member 20 is greater than the sine of the angle of taper.

It has been discovered that when inserts are pressfitted into the sockets on the cutter members, the walls of the sockets tend to be warped and a proper fit along the full length of the insertion is not obtained. When this happens, the inserts tend to become disoriented in the sockets during the earth boring operation and premature failure of the cutter can result. Prior to the present invention, the inserts were generally cylindrical sections pressed into radial cylindrical sockets in the cutter member. Since the cutter members have a circular cross section, the interference fit at the lower portion of the socket caused expansion of the socket at the upper portion and loss of fit. The loss of fit resulted in the inserts becoming loosened in the cutter member body and premature failure of the cutter member resulted. Cone peeling was also encountered.

The diameter of the base section 22 of insert 19 measured midway along the length of base section 22 as best shown in FIG. 3, is approximately the same size or slightly larger than the diameter of the socket 20. A comparison of the shape of the base section 22 of insert 19 and the shape of socket 20 shows base section 22 to be slightly tapered and socket 20 to be cylindrical. With the outer surface of the base section 22 of the insert 19 tapered, it will be appreciated that prior to assembly the ratio of the diameter of a section of the base surface 22 to the diameter of a corresponding section of the socket 20 is greater than the ratio of the diameter of a lower section of base surface 22 to the diameter of a corresponding section of the socket 20. The surface of base section 22 and the wall of socket 20 could be thought of as diverging from top to bottom even though it is understood that the diameter of insert 19 measured midway along the length of base section 22 is at least the same size or larger than the diameter of socket 20. When the insert 19 is press-fitted into the socket 20, the insert 19 will be retained in the cone cutter 14 by hoop tension. The tapered surface of base section 22 provides an improved fit of insert 19 in socket 20.

Figure 4:
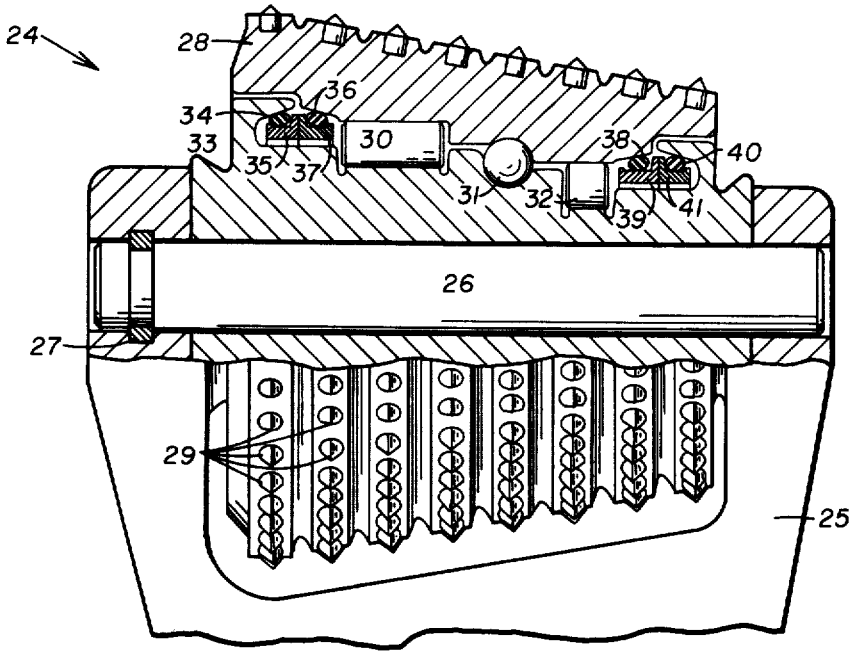
FIG. 4 illustrates another embodiment of the present invention.

Referring now to FIG. 4, another embodiment of the present invention is illustrated. A cylindrical earth boring cutter 24 is mounted in a saddle 25. The saddle 25 may be the saddle of a tunnel boring machine or an earth drilling bit such as a raise bit. The cutter 24 includes a multiplicity of carbide inserts 29 arranged to form a series of annular rows. The cutter 24 includes an annular cutter shell 28 positioned around a bearing shell 33. The bearing shell 33 is securely locked in the saddle 25 by a main pin 26 and a retainer nail or roll pin 27. The bearing shell 33 remains firmly locked in place throughout the drilling operation due to a tenon and groove arrangement disclosed in U.S. Pat. No. 3,203,492 to C. L. Lichte patented Aug. 31, 1965.

A multiplicity of bearing systems including a series of ball bearings 31, a series of inner roller bearings 32 and a series of outer roller bearings 30 promote rotation of the cutter shell 28 about the bearing shell 33. Lubricant is retained in the bearing area by two sets of seal elements. The inner set of seal elements includes a pair of annular metal seal rings 39 and 41 that are positioned near the inner end of the cutter 24. A flexible rubber O-ring 40 is positioned between the seal ring 41 and the bearing shell 33 to retain the seal ring 41 in the desired position and resiliently urge seal ring 41 against seal ring 39. A flexible rubber O-ring 38 is positiond between the cutter shell 28 and the seal ring 39 to retain the seal ring in a desired position and resiliently urge the seal ring 39 against seal ring 41. The outer set of seal elements includes a pair of annular metal seal rings 35 and 37 that are positioned near the outer end of the cutter 24. A flexible rubber O-ring 34 is positioned between the seal ring 35 and bearing shell 33 to retain the seal ring 35 in the desired position and resiliently urge seal ring 35 against seal ring 37. A flexible rubber O-ring 36 is positioned between the cutter shell 28 and seal ring 37 to retain seal ring 37 in the desired position and resiliently urge seal ring 37 against seal ring 35.

Figure 5:
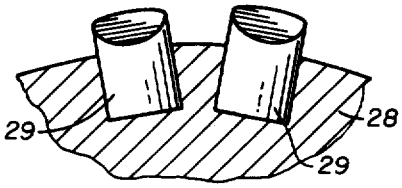
FIG. 5 is a sectional view of a portion of the cutter shown in FIG. 4.
Figure 6:
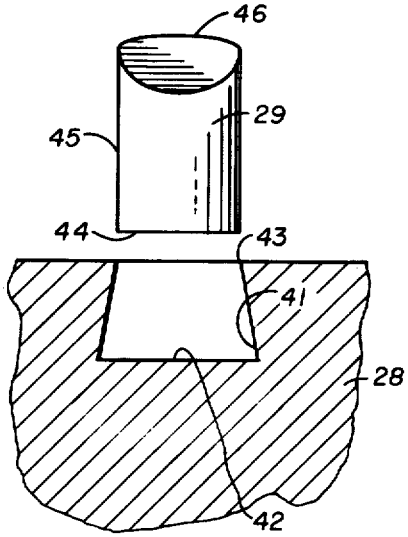
FIG. 6 is an enlarged view of one of the inserts in the cutter shown in FIGS. 4 and 5.

Referring now to FIG. 5, a cut-away portion of the cutter shell 28 is shown from an end view. Two adjacent inserts 29 are shown positioned in the cutter shell 28. Each of the inserts 29 have an elongated head portion that is adapted to contact the formations. FIG. 6 shows one of the inserts 29 prior to assembly in the cutter shell 28. The insert 29 includes a base adapted to be positioned in the socket 41. The upper portion of the insert 29 is formed into a chisel crest portion 46 for contacting and disintegrating the earth formations. The base of insert 29 terminates in a lower end 44. The base of the insert 29 is pressed through the socket mouth 43 into the socket 41 until the end 44 of the insert 29 contacts the bottom 42 of the socket 41. The outer surface of the base is cylindrical and the inside surface of the socket is tapered such that upon assembly of the insert 29 in the socket 41, the outer surface of the base and the inside surface of the socket 41 will have an improved fit. The angle of the taper of the tapered surface is such that the coefficient of friction of the tungsten carbide insert 29 and the softer cutter member 28 is greater than the sine of the angle of taper.

It has been discovered that when inserts are pressfitted into the sockets on a cutter, the walls of the sockets tend to be warped and a proper fit along the full length of the insertion is not obtained. When this happens, the inserts tend to become disoriented in the sockets during the earth boring operation and premature failure of the cutter can result. Prior to the present invention, the inserts were generally cylindrical sections pressed into radial cylindrical sockets in the cutter. Since the cutters have a circular cross section, the interference fit at the lower portion of the socket caused expansion of the socket at the upper portion and loss of fit. The loss of fit resulted in the inserts becoming loosened in the cutter member body and premature failure of the cutter member resulted.

The diameter of the insert 29 as best shown in FIG. 6, is approximately the same size or slightly larger than the diameter of the socket 41. A comparison of the shape of the base 45 of insert 29 and the shape of socket 42 shows the base 45 to be cylindrical and the socket 41 to be slightly tapered. With the wall of socket 41 being tapered, it will be appreciated that prior to assembly the ratio of the diameter of a section of the base of insert 29 to the diameter of a corresponding section of the socket 41 is greater than the ratio of the diameter of a lower section of the base to the diameter of a corresponding section of the socket 41. The surface of the base of insert 29 and the wall of socket 41 could be thought of as diverging from top to bottom even though it is understood that the diameter of insert 29 is at least the same size or larger than the diameter of socket 41. When the insert 29 is press-fitted into the socket 41, the insert 29 will be retained in the cutter 28 by hoop tension. The tapered surface of the socket 41 provides an improved fit of insert 29 in socket 41.

Figure 7:
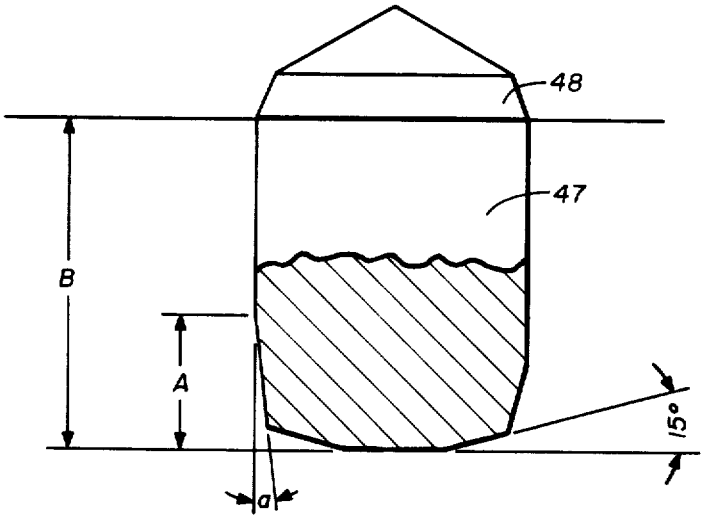
FIG. 7 illustrates still another embodiment of the present invention.

Referring now to FIG. 7, a view partially in section of another embodiment of an insert constructed in accordance with the present invention is illustrated. The insert 47 is constructed of a hard metal such as tungsten carbide. The insert 47 is adapted to be mounted in a cylindrical socket in the body of a cutter member. The insert 47 includes a base section having a length B. The base section fits within a socket in a cutter member. The upper portion of the insert 47 is formed into a formation contacting head 48. A substantial portion of the base of insert 47 is tapered. The tapered portion has a length A and the tapered portion of the base of the insert is tapered at a tapered angle a. The length A is a substantial portion of the length B and the angle a has a sine less than the coefficient of friction of the cutter and insert.

Figure 8:
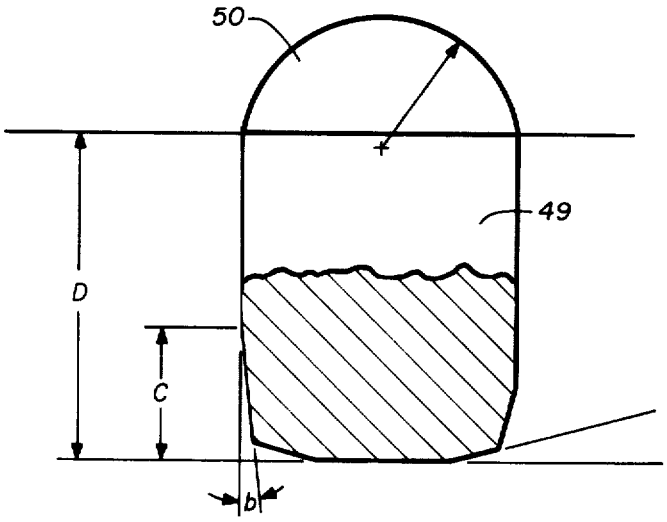
FIG. 8 illustrates yet another embodiment of the present invention.

Referring now to FIG. 8, a view partially in section of another embodiment of an insert constructed in accordance with the present invention is illustrated. The insert 49 is constructed of a hard metal such as tungsten carbide. The insert 49 is adpted to be mounted in a cylindrical socket in the body of a cutter member. The insert 49 includes a base section having a length D. The base section fits within a socket in a cutter member. The upper portion of the insert 49 is formed into a rounded formation contacting head 50. A substantial portion of the base of insert 49 is tapered. The tapered portion has a length C and the tapered portion of the base of the insert is tapered at a tapered angle b. The length C is a substantial portion of the length D and the angle b has a sine less than the coefficient of friction of the cutter and insert.

The embodiments of the invention in which an exclusive property or privilege is claimed are defined as follows:

1. In an earth boring apparatus having a body member retaining at least one insert, wherein upon assembly of said insert in said body member said insert is positioned in a socket in the body member, said socket having a socket wall and a socket bottom and said insert having a lower body portion and a lower end, the improvement comprising:

at least a substantial annular portion of one of said said socket wall and lower body portion being tapered and the other of said socket wall and lower body portion being cylindrical so that said socket wall and lower body portion tend to diverge toward said socket bottom and lower end, said socket wall and lower body portion being in contact when said insert is positioned in said socket in said body member.

2. In the earth boring apparatus of claim 1, one of said socket wall and lower body portion having a tapered surface, said tapered surface being tapered at an angle wherein the sine of the angle is less than the coefficient of friction of the insert and body member.

3. In a rock drill bit having an insert receiving socket for receiving a hardened insert, wherein the socket has an inner wall and the insert has an outer wall and a lower end, the improvement comprising:

said socket inner wall being cylindrical and said insert outer wall having a substantial tapered portion extending along substantially the entire outer wall, tapering inward toward said lower end, said socket inner wall contacting said insert outer wall when said insert is within said receiving socket.

4. In the rock drill bit of claim 3, said tapered portion being a self-locking taper.

5. In a rock drill bit having an insert receiving socket for receiving a hardened insert, wherein the socket has an inner wall and bottom and the insert has an outer wall, the improvement comprising:

said socket inner wall being tapered outward toward said bottom and said insert outer wall being cylindrical.

* * * * *